US008161952B2

(12) United States Patent
Satou

(10) Patent No.: US 8,161,952 B2
(45) Date of Patent: Apr. 24, 2012

(54) ELECTRONICALLY CONTROLLED BLOW-BY GAS RETURNING APPARATUS FOR INTERNAL COMBUSTION ENGINE

(75) Inventor: Fumikazu Satou, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 585 days.

(21) Appl. No.: 12/393,551

(22) Filed: Feb. 26, 2009

(65) Prior Publication Data

US 2009/0235907 A1 Sep. 24, 2009

(30) Foreign Application Priority Data

Mar. 18, 2008 (JP) ..... 2008-069946

(51) Int. Cl.
*F01M 13/00* (2006.01)
*F02M 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 5,331,940 A * 7/1994 Takayama ..... 123/679
2008/0257320 A1* 10/2008 Asanuma et al. ..... 123/573

FOREIGN PATENT DOCUMENTS

| | | |
|---|---|---|
| DE | 102 22 808 A1 | 11/2003 |
| JP | 61-99617 | 6/1986 |
| JP | 2005-315172 | 11/2005 |
| JP | 2006-52664 | 2/2006 |

* cited by examiner

*Primary Examiner* — M. McMahon
(74) *Attorney, Agent, or Firm* — Oblon, Spivak, McClelland, Maier & Neustadt, L.L.P.

(57) ABSTRACT

An electronically controlled blow-by gas returning apparatus for an internal combustion engine which corrects a fuel injection amount is disclosed. This blow-by gas returning apparatus is provided with an electronically controlled ventilation valve and a control unit. The ventilation valve regulates the flow rate of blow-by gas. The control unit controls the ventilation valve. The control unit controls the opening degree of the ventilation valve such that the actual value of the opening degree of the ventilation valve is maintained at a demand value of the opening degree of the ventilation valve. The control unit corrects the demand value based on the degree of enrichment of the actual air-fuel ratio in relation to a target air-fuel ratio and an intake air amount which is the amount of air fed into a combustion chamber of the internal combustion engine.

13 Claims, 9 Drawing Sheets

Fig.4A
Fig.4B
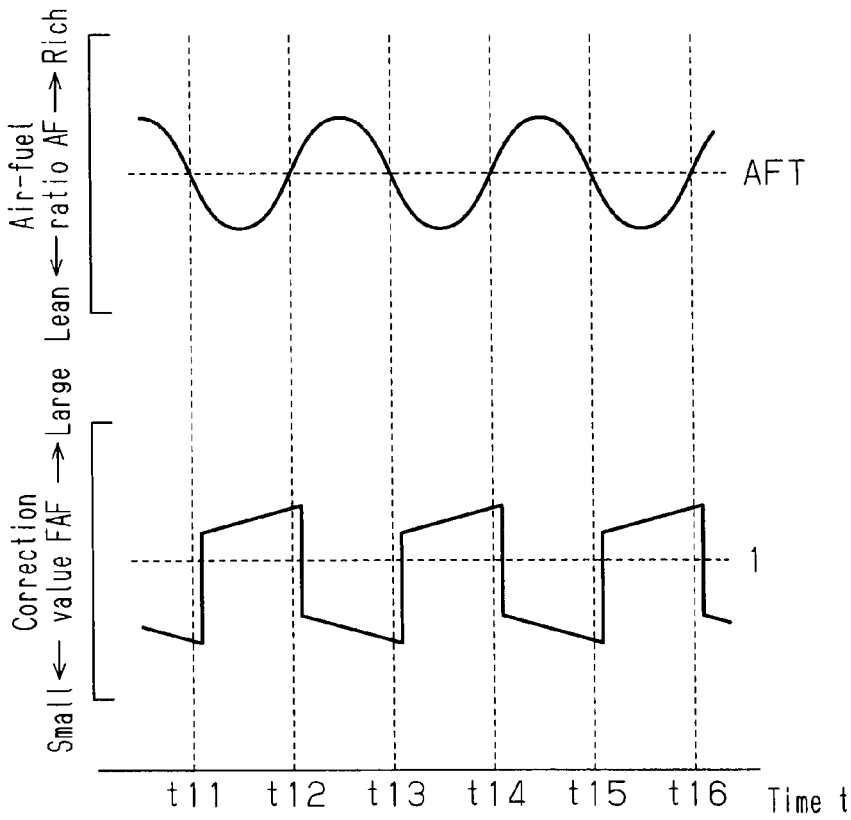
Fig.5
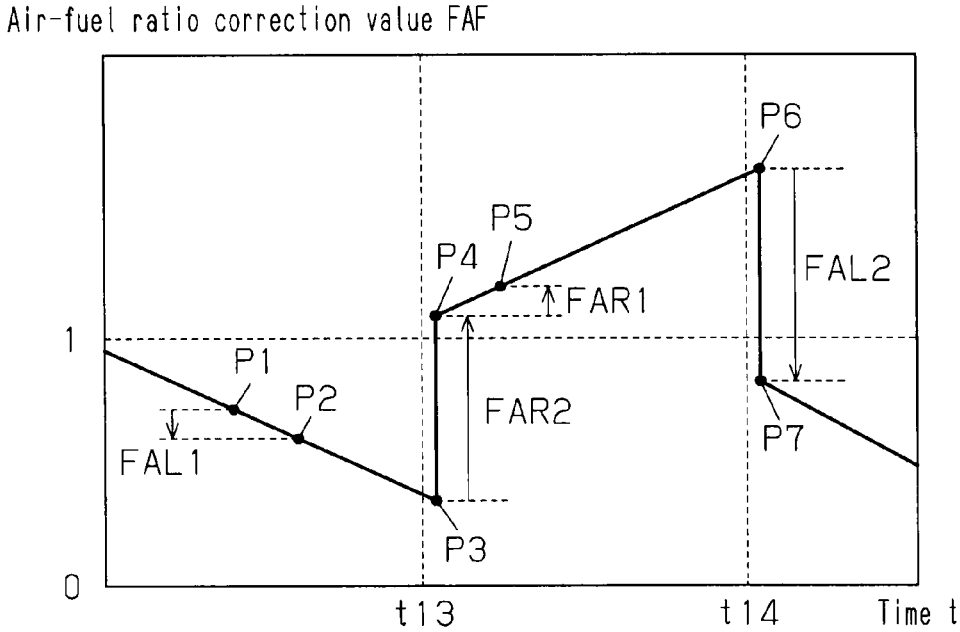

ELECTRONICALLY CONTROLLED BLOW-BY GAS RETURNING APPARATUS FOR INTERNAL COMBUSTION ENGINE

FIELD OF THE INVENTION

The present invention relates to an electronically controlled blow-by gas returning apparatus used in an internal combustion engine, in which a correction value of a fuel injection amount is set such that when the actual air-fuel ratio deviates to the rich side with respect to a target air-fuel ratio, the actual air-fuel ratio approaches the target air-fuel ratio. More specifically, the present invention relates to a blow-by gas returning apparatus that has an electronically controlled ventilation valve for regulating the flow rate of blow-by gas fed into an intake passage from the inside of a crank chamber of the internal combustion engine.

BACKGROUND OF THE INVENTION

Japanese Laid-Open Patent Publication No. 2006-52664 discloses a blow-by gas returning apparatus for an internal combustion engine. This blow-by gas returning apparatus is generally provided with a first ventilation passage that connects a portion of an intake passage that is downstream of a throttle valve to a crank chamber, thereby feeding blow-by gas in the crank chamber into the intake passage, a second ventilation passage that connects a portion of the intake passage that is upstream of the throttle valve to the crank chamber, thereby feeding intake air into the intake passage, and an electronically controlled ventilation valve for regulating the flow rate of blow-by gas passing through the first ventilation passage. A demand value of the flow rate of blow-by gas is set based on an engine operating state during operation of the internal combustion engine, and the opening degree of the ventilation valve is controlled such that the actual flow rate of blow-by gas becomes the demand value.

When diluted fuel evaporates from engine lubricant oil with a high fuel dilution ratio in the crank chamber, a large amount of fuel in the crank chamber is fed into the intake air passage together with blow-by gas, and therefore, the actual air-fuel ratio is excessively enriched with respect to the target air-fuel ratio. Thus, it is considered that when the fuel dilution ratio of the engine lubricant oil is high, the ventilation valve may be closed to stop the feed of blow-by gas into the intake air passage. However, since the crank chamber is not ventilated, this is not an effective method.

In the blow-by gas returning apparatus disclosed in the above publication, the actual injection time is fixed to the minimum injection time when a required injection time of an injector is below the minimum injection time, and the ventilation valve is controlled such that the actual air-fuel ratio approaches the target air-fuel ratio, whereby the air-fuel ratio is inhibited from remaining in the state of being excessively enriched. However, even when the air-fuel ratio is excessively enriched until the required injection time falls below the minimum injection time, the ventilation valve is not controlled.

SUMMARY OF THE INVENTION

An objective of the present invention is to provide an electronically controlled blow-by gas returning apparatus for an internal combustion engine, which can appropriately inhibit the occurrence of a state where an air-fuel ratio is excessively enriched, while ventilating the crank chamber.

To achieve the foregoing objective and in accordance with one aspect of the present invention, an electronically controlled blow-by gas returning apparatus for an internal combustion engine is provided. The engine corrects a fuel injection amount such that the fuel injection amount is reduced in accordance with a degree of enrichment of an actual air-fuel ratio in relation to a target air-fuel ratio. The apparatus includes an electronically controlled ventilation valve and a control unit. The electronically controlled ventilation valve regulates a flow rate of blow-by gas in a crank chamber of the engine fed into an intake passage. The control unit controls the ventilation valve. The control unit sets a demand value of an opening degree of the ventilation valve based on an engine operating state, and controls the opening degree of the ventilation valve such that the actual value of the opening degree of the ventilation valve is maintained at the demand value. The control unit corrects the demand value based on the degree of enrichment and an intake air amount, which is the amount of air fed into a combustion chamber of the internal combustion engine.

BRIEF DESCRIPTION OF THE DRAWINGS

The invention, together with objects and advantages thereof, may best be understood by reference to the following description of the presently preferred embodiments together with the accompanying drawings in which:

FIG. 4A is a timing chart showing changes in an air-fuel ratio caused by the electronically controlled blow-by gas returning apparatus of FIG. 1;

FIG. 4B is a timing chart showing changes in an air-fuel ratio correction value caused by the electronically controlled blow-by gas returning apparatus of FIG. 1;

FIG. 5 is a timing chart showing a part of FIG. 4B;

DETAILED DESCRIPTION OF THE PREFERRED EMBODIMENT

An electronically controlled blow-by gas returning apparatus for an internal combustion engine according to one embodiment of the present invention is described with reference to FIG. 1 to FIG. 12. The blow-by gas returning apparatus of the present embodiment is applied to an in-cylinder injection internal combustion engine for vehicles.

Figure 1:
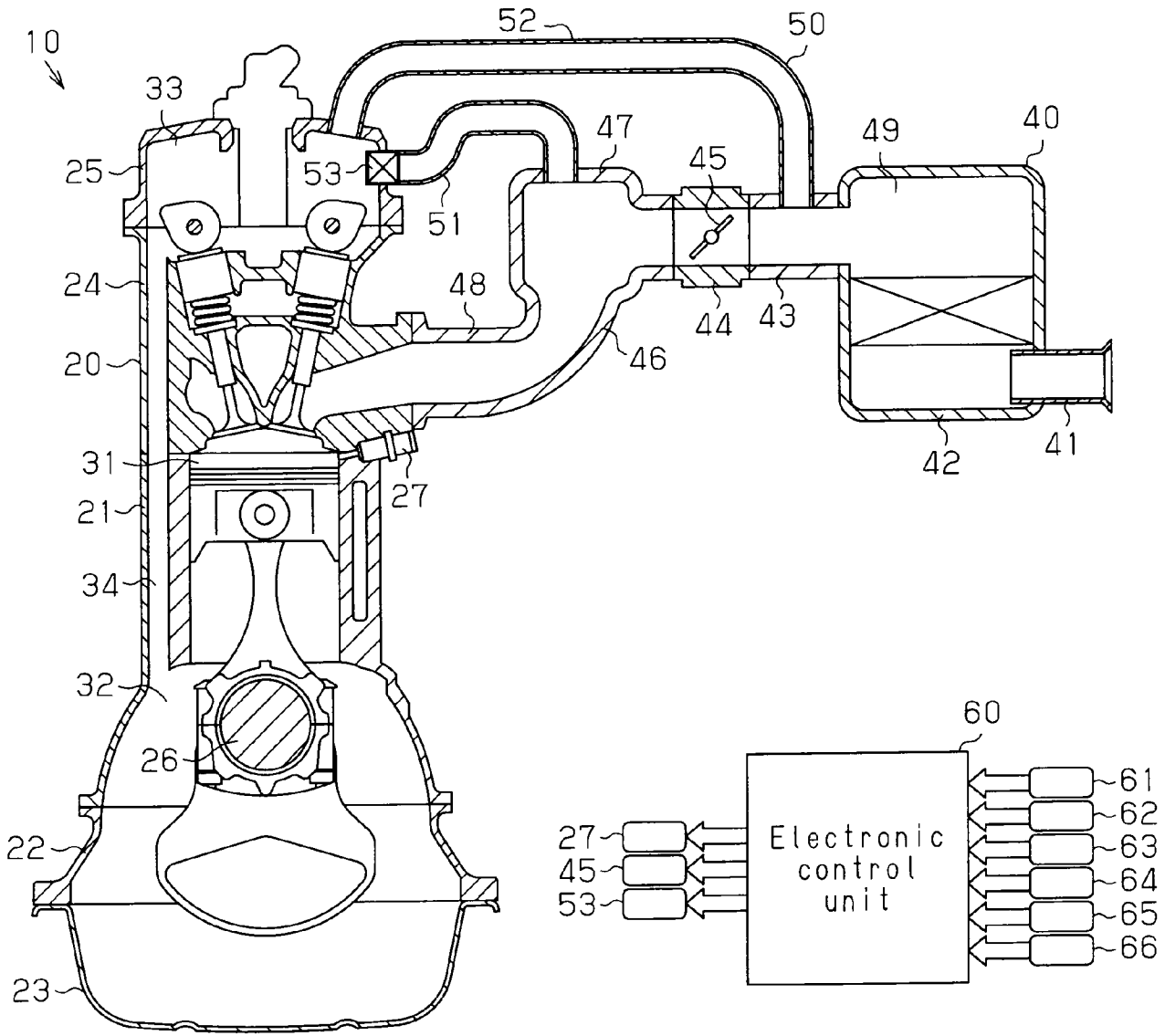
FIG. 1 is a diagram schematically showing the configuration of an in-cylinder injection internal combustion engine having an electronically controlled blow-by gas returning apparatus according to one embodiment of the present invention.

As shown in FIG. 1, an in-cylinder injection engine 10 is provided with an engine body 20 for producing power by combustion of air-fuel mixture composed of air and fuel, an intake device 40 for taking external air into the engine body 20, an electronically controlled blow-by gas returning apparatus 50 for feeding blow-by gas in the engine body 20 into the intake device 40, and an electronic control unit 60 as a control unit for integrally controlling these devices.

The engine body 20 is provided with a cylinder block 21, a crankcase 22, an oil pan 23, a cylinder head 24, and a head cover 25. The air-fuel mixture, which is composed of fuel directly injected into a combustion chamber 31 via an injector 27, and air fed into the combustion chamber 31 via the intake device 40, is combusted in the cylinder block 21. The crankcase 22 and the cylinder block 21 support the crankshaft 26. The oil pan 23 stores engine oil. The cylinder head 24 includes parts disposed therein which constitute a valve operating system. The head cover 25 inhibits the engine oil from being scattered to the outside. The crank chamber 32 is formed by the cylinder block 21 and the crankcase 22, and a valve operating chamber 33 is formed by the cylinder head 24 and the head cover 25. The crank chamber 32 and the valve operating chamber 33 are connected with each other through a communication chamber 34 formed in the cylinder block 21.

The intake device 40 is provided with an air intake 41, an air cleaner 42, an intake hose 43, a throttle body 44, and an intake manifold 46. The air intake 41 takes external air into the intake device 40. The air cleaner 42 captures foreign substances in the air (hereinafter referred to as "intake air") taken through the air intake 41. The throttle body 44 regulates the flow rate of the intake air through the opening and closing of the throttle valve 45. The intake hose 43 connects a portion of the intake downstream of the air cleaner 42 to a portion of the intake upstream of the throttle body 44. The intake manifold 46 connects a portion of the intake downstream side of the throttle body 44 to a portion of the intake upstream of the cylinder head 24. The intake manifold 46 has a surge tank 47 in which the intake air passing through the throttle body 44 is accumulated and a plurality of sub pipes 48 through which the intake air in the surge tank 47 is fed into each of a plurality of intake ports of the cylinder head 24. That is, in the intake device 40, an intake passage 49 through which the intake air is fed into the engine body 20 is constituted of a passage in the air intake 41, a passage in the air cleaner 42, a passage in the intake hose 43, a passage in the throttle body 44, and a passage in the intake manifold 46.

The blow-by gas returning apparatus 50 has the following three functions: (1) feeding blow-by gas, flowing out of the combustion chamber 31 to flow into the crank chamber 32, to the intake downstream side of the throttle valve 45 in the intake device 40; (2) feeding intake air, cleaned by the air cleaner 42, from the intake upstream side of the throttle valve 45 in the intake device 40 to the inside of the crank chamber 32; and (3) regulating the flow rate of blow-by gas in the engine body 20 fed into the intake device 40.

Specifically, the blow-by gas returning apparatus 50 is provided with a first ventilation passage 51 which is a passage for feeding blow-by gas in the crank chamber 32 from the inside of the valve operating chamber 33 to the inside of the surge tank 47 and is formed so as to connect the head cover 25 to the surge tank 47. The blow-by gas returning apparatus 50 is further provided with a second ventilation passage 52 through which the intake air in the intake hose 43 is fed into the valve operating chamber 33 and the intake air is fed from the inside of the valve operating chamber 33 to the inside of the intake hose 43. The second ventilation passage 52 is formed so as to connect the head cover 25 to the intake hose 43. The blow-by gas returning apparatus 50 is further provided with a PCV valve 53 for regulating the flow rate of blow-by gas flowing from the inside of the valve operating chamber 33 toward the inside of the surge tank 47. The PCV valve 53 is provided in the head cover 25 and changes the cross-sectional area of the flow passage of the first ventilation passage 51. When the opening degree of the PCV valve 53 (hereinafter referred to as a PCV opening degree TB) increases under the same engine operating conditions, the flow rate of blow-by gas fed from the inside of the valve operating chamber 33 to the inside of the surge tank 47 also increases.

Figure 2:
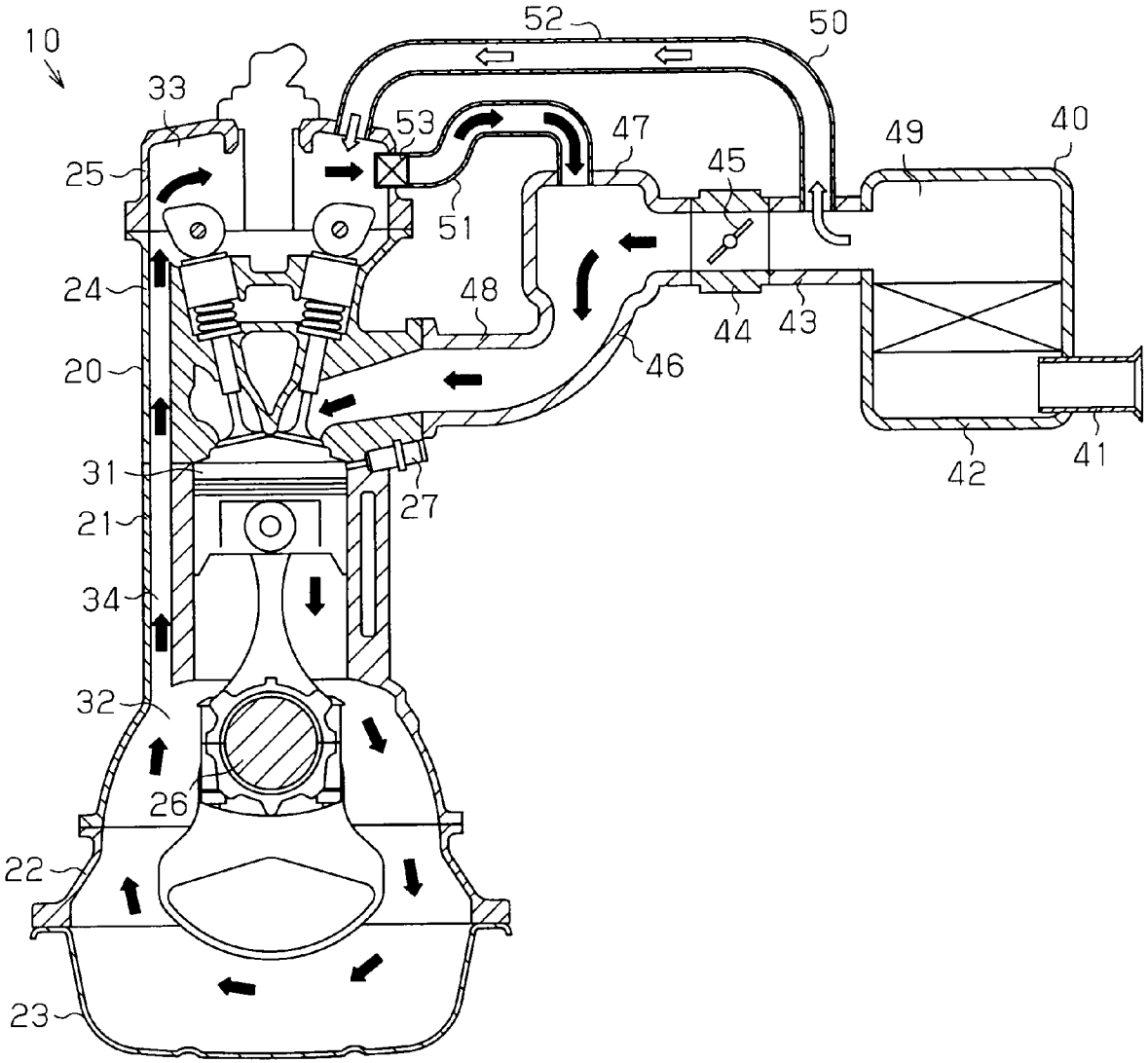
FIG. 2 is a diagram showing a manner in which blow-by gas and intake air flow in a low load operation of the in-cylinder injection internal combustion engine of FIG. 1.

As shown in FIG. 2, a large negative pressure is generated on the intake downstream side of the throttle valve 45 in a low load operation of the engine, and therefore, blow-by gas in the crank chamber 32 flows into the surge tank 47 via a communication chamber 34, the valve operating chamber 33, and the first ventilation passage 51 as indicated by solid arrows. At this time, the intake air flows from the inside of the intake hose 43 to the valve operating chamber 33 via the second ventilation passage 52 as indicated by white arrows.

Figure 3:
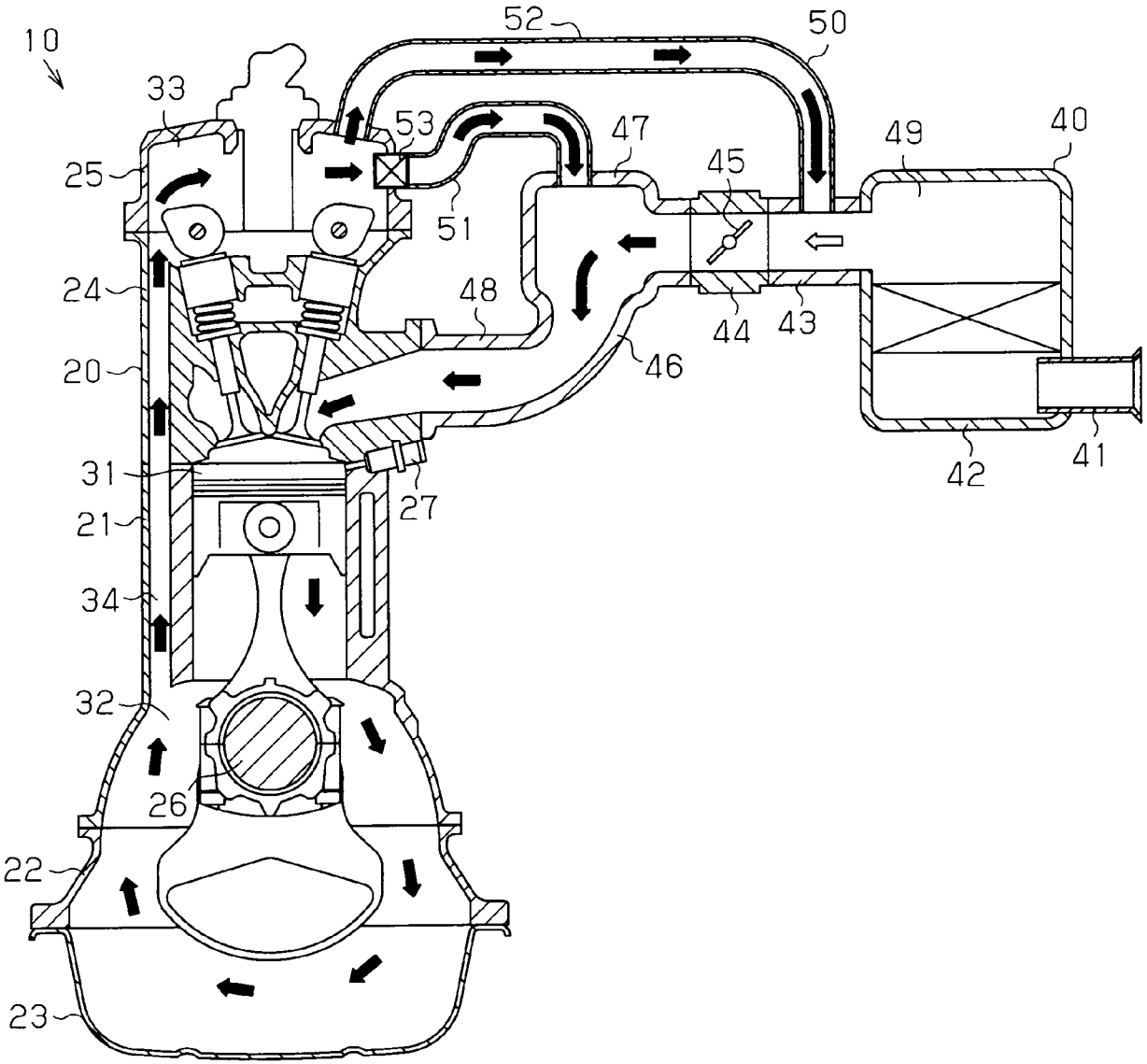
FIG. 3 is a diagram showing a manner in which blow-by gas and intake air flow in a high load operation of the in-cylinder injection internal combustion engine of FIG. 1.

As shown in FIG. 3, a large pressure is generated in the crank chamber 32 and the valve operating chamber 33 in a high load operation of the engine, and therefore, blow-by gas in the crank chamber 32 flows into the surge tank 47 via the communication chamber 34, the valve operating chamber 33, and the first ventilation passage 51, and, at the same time, the blow-by gas in the valve operating chamber 33 flows into the intake hose 43 via the second ventilation passage 52 as indicated by white arrows.

As shown in FIG. 1, the electronic control unit 60 inputs signals output from an accelerator position sensor 61, a crank position sensor 62, an air flow meter 63, a throttle position sensor 64, a coolant temperature sensor 65, and an air-fuel ratio sensor 66. These sensors 61 to 66 assist in the control of the engine 10 performed by the electronic control unit 60. The accelerator position sensor 61 outputs a signal corresponding to a depression amount of an accelerator pedal of the vehicle (hereinafter referred to as an accelerator operation amount AC). The crank position sensor 62 outputs a signal corresponding to the rotational speed of a crankshaft 26 (hereinafter referred to as an engine rotational speed NE). The air flow meter 63 outputs a signal corresponding to a mass flow rate of intake air flowing through the intake passage 49 (hereinafter referred to as an intake air flow rate GF). The throttle position sensor 64 outputs a signal corresponding to the opening degree of the throttle valve 45 (hereinafter referred to as a throttle opening degree TA). The coolant temperature sensor 65 outputs a signal corresponding to a temperature of engine coolant for cooling the engine body 20 (hereinafter referred to as a coolant temperature THW). The air-fuel ratio sensor 66 outputs a signal corresponding to the air-fuel ratio of a air-fuel mixture (hereinafter referred to as an air-fuel ratio AF) based on the concentration of oxygen in an exhaust gas.

The electronic control unit 60 acquires a request from a driver and the engine operating state based on the detection results from the sensors 61 to 66 to perform various controls such as throttle control for regulating the intake air flow rate GF, injection control for regulating fuel injection amount (hereinafter referred to as an injection amount QI) from the injector 27, air-fuel ratio control for making the air-fuel ratio AF of air-fuel mixture approach a target value, and ventilation control for regulating the flow rate of blow-by gas (hereinafter referred to as PCV flow rate GB) in the engine body 20 fed into the intake device 40.

In the throttle control, the electronic control unit 60 acquires a demand value of the engine load based on the accelerator operation amount AC and the engine rotational speed NE, sets as a target value the intake air flow rate GF corresponding to this demand value, and controls the opening degree of the throttle valve 45 such that the intake air flow rate GF from the air flow meter 63 approaches this target value.

In the injection control, the electronic control unit 60 acquires the amount of air fed into the combustion chamber 31 (hereinafter referred to as an intake air amount GA) based on the intake air flow rate GF from the air flow meter 63 to set as a basic injection amount QIB the injection amount QI of fuel, in which the target value is the air-fuel ratio of air-fuel mixture, based on the intake air amount GA. The electronic control unit 60 sets a final demand value of the injection amount QI (hereinafter referred to as a demand value QIT of the injection amount) in which a corrected injection amount QIF which is set based on another control is reflected in the basic injection amount QIB and controls the injector 27 such that the actual injection amount QI (hereinafter referred to as the actual value QIR of the injection amount) becomes the demand value QIT.

In the ventilation control, the electronic control unit 60 sets the PCV flow rate GB required based on the engine load and the engine rotational speed NE (hereinafter referred to as a demand value GBT of the PCV flow rate). The electronic control unit 60 sets the PCV opening degree TB, with which the actual PCV flow rate GB (hereinafter referred to as an actual value GBR of the PCV flow rate) is estimated to be maintained at the demand value GBT, as the demand value of the PCV opening degree TB (hereinafter referred to as a demand value TBT of the PCV opening degree), and controls the opening degree of the PCV valve 53 such that the actual PCV opening degree TB (hereinafter referred to as an actual value TBR of the PCV opening degree) is maintained at the demand value TBT. The engine load can at any given time be acquired using as an index the ratio of the actual intake air amount to the maximum value of the intake air amount capable of being fed into the combustion chamber 31 or the ratio of the actual value of the injection amount QI (a demand value of the injection amount QI) to the maximum value of the injection value QI from the injector 27.

In the air-fuel ratio control, the electronic control unit 60 sets a correction factor for the basic injection amount QIB based on the deviation amount and the deviation tendency between a target air-fuel ratio AF (hereinafter referred to as a target value AFT of the air-fuel ratio) and the air-fuel ratio AF from the air-fuel ratio sensor 66 (hereinafter referred to as an actual value AFR of the air-fuel ratio). The basic injection amount QIB is corrected with the correction factor, whereby the correction injection amount QIF for making the actual value AFR of the air-fuel ratio approach the target value AFT is calculated.

Further, in the air-fuel ratio control, the electronic control unit 60 performs air-fuel ratio feedback control for calculating a correction factor (hereinafter referred to as an air-fuel ratio correction value FAF) for the injection amount QI, which is used for compensating for temporal deviation of the actual value AFR of the air-fuel ratio from the target value AFT of the air-fuel ratio. The electronic control unit 60 further performs air-fuel ratio learning control for calculating a correction factor for the injection amount QI (hereinafter referred to as an air-fuel ratio learning value FAG), which is used for compensating for steady deviation of the actual value AFR of the air-fuel ratio from the target value AFT of the air-fuel ratio.

The air-fuel ratio feedback control will now be described in detail with reference to FIGS. 4A to 5. FIGS. 4A and 4B show changes in the actual value AFR of the air-fuel ratio and the air-fuel ratio correction value FAF with respect to a time axis. FIG. 5 shows a part of changes in the air-fuel ratio correction value FAF of FIG. 4B.

As shown in FIGS. 4A and 4B, when the actual value AFR of the air-fuel ratio deviates to the rich side with respect to the target value AFR of the air-fuel ratio, for example, with respect to the stoichiometric air-fuel ratio (before time t11, between time t12 and time t13, between time t14 and time t15, and after time t16), the air-fuel correction value FAF is set to be smaller than 1, which is a reference value of the injection amount QI, such that the injection amount QI is reduced. Meanwhile, when the actual value AFR of the air-fuel ratio deviates to the lean side with respect to the target value AFT of the air-fuel ratio (between time t11 and time t12, between time t13 and time t14, and between time t15 and time t16), the air-fuel ratio correction value FAF is set to be greater than "1" which is the reference value of the injection amount QI such that the injection amount QI increases.

Specifically, the air-fuel ratio correction value FAF is updated in the following manner.

In FIG. 4A, the actual value AFR of the air-fuel ratio deviates to the rich side with respect to the target value AFT of the air-fuel ratio between time t12 and time t13. At this time, as shown in a section prior to time t13 in FIG. 5, a gradual change value FALL is subtracted from the air-fuel ratio correction value FAF for every predetermined calculation period. That is, when the air-fuel ratio correction value FAF is located at point P1, the gradual change value FAL1 is subtracted, whereby updating is performed such that the air-fuel ratio correction value FAF is located at point P2. The updating of the air-fuel ratio correction value FAF is continued until time t13 in this manner, whereby the actual value AFR of the air-fuel ratio is changed from the state of deviating to the rich side with respect to the target value AFT of the air-fuel ratio to the state of deviating to the lean side.

Next, when the above change is detected through the air-fuel ratio sensor 66, a rapid change value FAR2 is added to the air-fuel ratio correction value FAF as shown in a section immediately after time 13 in FIG. 5. That is, when the air-fuel ratio correction value FAF is located at point P3, the rapid change value FAR2 is added to the air-fuel ratio correction value FAF, whereby updating is performed such that the air-fuel ratio correction value FAF is located at point P4. The updating of the air-fuel ratio correction value FAF is performed in this manner, whereby the air-fuel ratio correction value FAF is changed from a value (smaller than the reference value "1") reducing the injection amount QI to a value (greater than the reference value "1") increasing the injection amount QI. The rapid change value FAR2 is set as a value preventing the actual value AFR of the air-fuel ratio from being rapidly inverted from the lean side to the rich side with respect to the target value AFT of the air-fuel ratio. Thus, as described above, also after the addition of the rapid change value FAR2 to the air-fuel ratio correction value FAF, the actual value AFR of the air-fuel ratio is for a while maintained in the state of deviating to the lean side with respect to the target value AFT of the air-fuel ratio (a period from time t13 to time t14 in FIG. 4A).

Next, as shown in FIG. 4A, in the period from time t13 to time t14, the actual value AFR of the air-fuel ratio deviates to the lean side with respect to the target value AFT of the air-fuel ratio. At this time, as shown in the section between time t13 and time t14 in FIG. 5, a gradual change value FAR1 is added to the air-fuel ratio correction value FAF for every predetermined calculation period. That is, when the air-fuel ratio correction value FAF is located at point P4, the gradual change value FAR1 is added, whereby the updating is performed so that the air-fuel ratio correction value FAF is located at point P5. The updating of the air-fuel ratio correction value FAF is continued in this manner, whereby the actual value AFR of the air-fuel ratio is changed from the state of deviating to the lean side with respect to the target value AFT of the air-fuel ratio to the state of deviating to the rich side (time t14 in FIG. 4A).

Next, when the above change is detected through the air-fuel ratio sensor 66, a rapid change value FAL2 is subtracted from the air-fuel ratio correction value FAF as shown in the section immediately after time t14 in FIG. 5. That is, when the air-fuel ratio correction value FAF is located at point P6, the rapid change value FAL2 is subtracted from the air-fuel ratio correction value FAF, whereby updating is performed so that the air-fuel ratio correction value FAF is located at point P7. The updating of the air-fuel ratio correction value FAF is performed in this manner, whereby the air-fuel ratio correction value FAF changes from the value (greater than the reference value "1") increasing the injection amount QI to the value (smaller than the reference value "1") reducing the injection amount QI. The rapid change value FAL2 is set as a value preventing the actual value AFR of the air-fuel ratio from being rapidly inverted from the rich side to the lean side with respect to the target value AFT of the air-fuel ratio. Thus, as described above, also after the subtraction of the rapid change value FAL2 from the air-fuel ratio correction value FAF, the actual value AFR of the air-fuel ratio is for a while maintained in the state of deviating to the rich side with respect to the target value AFT of the air-fuel ratio (a period from time t14 to time t15 in FIG. 4A).

The air-fuel ratio learning control is performed in the following manner concurrently with the air-fuel ratio feedback control performed in the manner shown above.

When there is no tendency that the actual value AFR of the air-fuel ratio steadily deviates to any one of the rich side and the lean side with respect to the target value AFT of the air-fuel ratio, the air-fuel ratio correction value FAF fluctuates between the rich side and the lean side with respect to "1"; therefore, the average value of the air-fuel ratio correction value FAF in this case shows a value equal to "1" which is substantially a reference value. Meanwhile, due to, for example, the individual difference of the injector 27 or the aging degradation, when the actual value AFR of the air-fuel ratio tends to steadily deviate to any one of the rich side and the lean side with respect to the target value AFT of the air-fuel ratio, the air-fuel ratio correction value FAF fluctuates between the rich side and the lean side with respect to a value different from the reference value "1", and therefore, the average value of the air-fuel ratio correction value FAF converges to a value different from the reference value "1". As described above, there is a difference in the average value of the air-fuel ratio correction value FAF between when there is no steady deviation between the actual value AFR of the air-fuel ratio and the target value AFT of the air-fuel ratio and when the steady deviation occurs between the actual value AFR and the target value AFT. Thus, based on such a fact, it is found that the actual value AFR and the target value AFT tend to steadily deviate.

When the average value of the air-fuel ratio correction value FAF is less than a predetermined value $\alpha$ previously set to be smaller than the reference value "1", the actual value AFR of the air-fuel ratio is determined to tend to steadily deviate to the rich side with respect to the target value AFT of the air-fuel ratio, and thus, in order to eliminate this tendency, the air-fuel ratio learning value FAG is updated. When the average value of the air-fuel ratio correction value FAF is not less than a predetermined value $\beta$ previously set to be greater than the reference value "1", the actual value AFR of the air-fuel ratio is determined to tend to steadily deviate to the lean side with respect to the target value AFT of the air-fuel ratio, and thus, in order to eliminate this tendency, the air-fuel ratio learning value FAG is updated. When the average value of the air-fuel ratio correction value FAF is within the range of not less than the predetermined value $\alpha$ and less than the predetermined value $\beta$, it is determined that there is no tendency that the actual value AFR of the air-fuel ratio steadily deviates to the rich side and the lean side with respect to the target value AFT of the air-fuel ratio, and thus, the air-fuel ratio learning value FAG at that time is maintained. The updating of the air-fuel ratio learning value FAG in the manner described above is performed for each of a plurality of learning regions set depending on the magnitude of the engine load. That is, when the actual engine load has a magnitude corresponding to a given learning region, the air-fuel ratio learning value FAG in the learning region is updated.

The air-fuel ratio correction value FAF and the air-fuel ratio learning value FAG, calculated in the above manner, are reflected, as the correction injection amount QIF, in the basic injection amount QIB in the injection control above. Since the air-fuel ratio correction value FAF and the air-fuel ratio learning value FAG are set as a correction factor for the basic injection amount QIB, a single correction factor (hereinafter referred to as an air-fuel ratio correction factor kFA) in which the air-fuel ratio correction value FAF and the air-fuel ratio learning value FAG are integrated with each other is reflected, as the correction injection amount QIF, in the basic injection amount QIB. That is, when the air-fuel ratio correction factor kFA based on the air-fuel ratio correction value FAF and the air-fuel ratio learning value FAG is a value for making the actual value AFR of the air-fuel ratio, deviating to the rich side with respect to the target value AFT of the air-fuel ratio, approach the target value AFT, the air-fuel ratio correction factor kFA as the correction injection amount QIF is reflected in the basic injection amount QIB, whereby the basic injection amount QIB is corrected to the reduction side. Meanwhile, the air-fuel ratio correction factor kFA based on the air-fuel ratio correction value FAF and the air-fuel ratio learning value FAG is a value for making the actual value AFR of the air-fuel ratio, deviating to the lean side with respect to the target value AFT of the air-fuel ratio, approach the target value AFT, the air-fuel ratio correction factor kFA as the correction injection amount QIF is reflected in the basic injection amount QIB, whereby the basic injection amount QIB is corrected to the increasing side.

Figure 6:
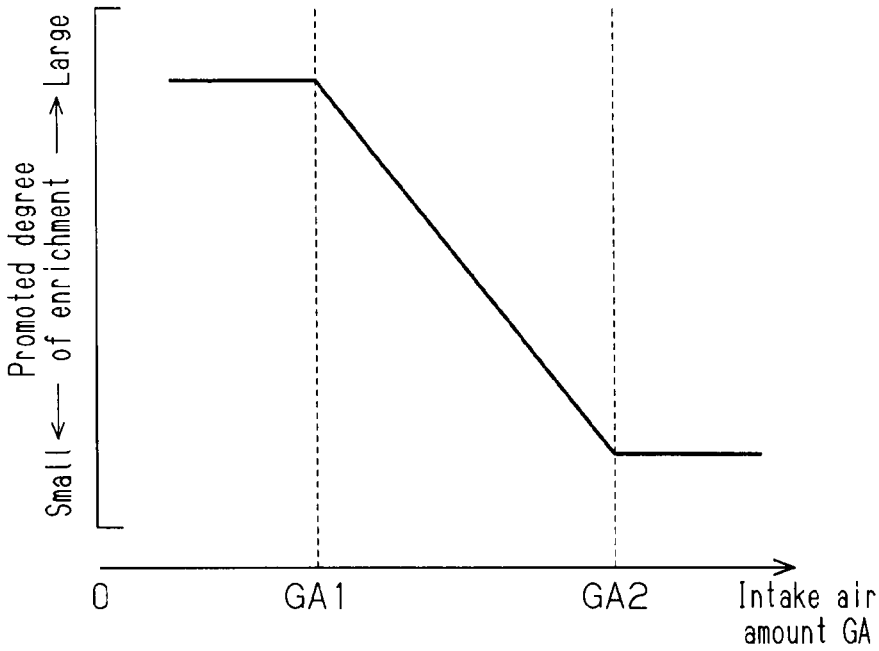
FIG. 6 is a graph showing a relationship between an intake air amount and a promoted degree of enrichment of the air-fuel ratio caused by returned fuel, according to the in-cylinder injection internal combustion engine of FIG. 1.
Figure 7:
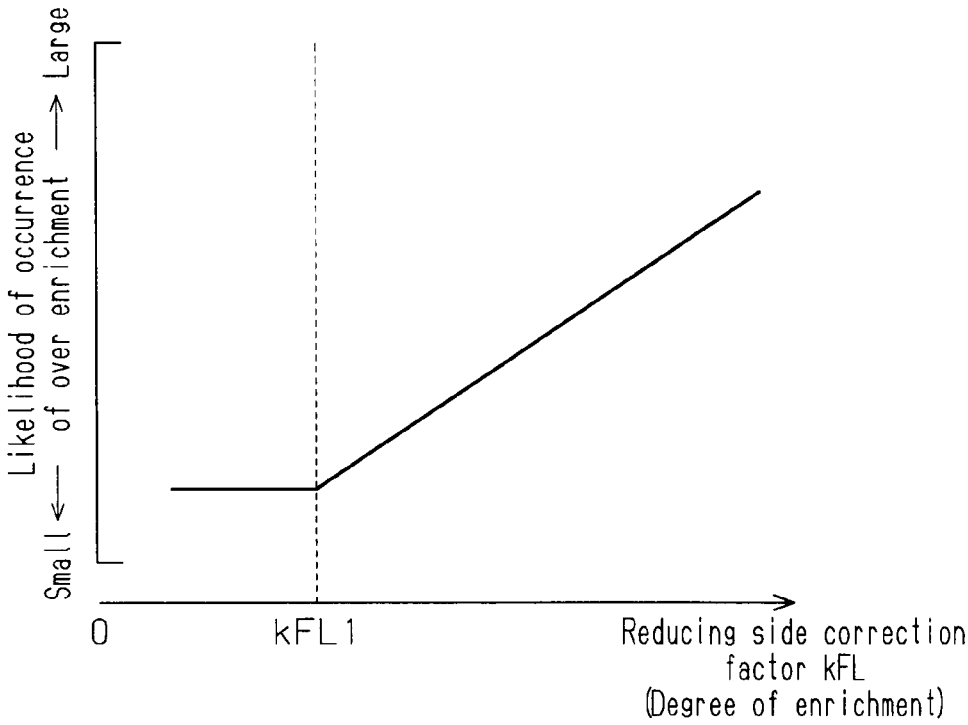
FIG. 7 is a graph showing a relationship between a reducing side correction factor (degree of enrichment of the air-fuel ratio) and the likelihood of the occurrence of over enrichment of the air-fuel ratio caused by returned fuel, according to the in-cylinder injection internal combustion engine of FIG. 1.

With reference to FIGS. 6 and 7, the manner in which the problems of the present invention are solved with be described. FIGS. 6 and 7 show a situation where diluted fuel evaporates from engine oil, and a predetermined amount of blow-by gas in the crank chamber 32 is fed into the intake passage 49.

Under these conditions, the amount of fuel fed into the combustion chamber 31 (hereinafter referred to as an in-chamber fuel amount QZ) is a combination of the actual value QIR of the injection amount from the injector 27 and the amount of returned fuel fed into the intake passage 49 together with the blow-by gas, and therefore, the actual value AFR of the air-fuel ratio basically deviates to the rich side with respect to the target value AFT of the air-fuel ratio. The air-fuel ratio correction factor kFA is calculated in this manner that the deviation to the rich side is eliminated in the air-fuel ratio control, and the air-fuel ratio correction factor kFA reflects in the basic injection amount QIB in the injection control, whereby the actual value AFR of the air-fuel ratio approaches the target value AFT of the air-fuel ratio.

However, when the actual value AFR of the air-fuel ratio excessively deviates to the rich side with respect to the target value AFT of the air-fuel ratio due to an excessively large returned fuel amount QR, the air-fuel ratio correction factor kFA is calculated through the air-fuel ratio control in order to eliminate the deviation as described above. However, due to the inability of the correction value FAF of the air-fuel ratio to correspond to the change in the actual value AFR of the air-fuel ratio, the actual value AFR of the air-fuel ratio cannot properly approach the target value AFT of the air-fuel ratio, that is, the air-fuel ratio control is not executed properly. In the following description, a state where the actual value AFR of the air-fuel ratio enriches to such an extent that the air-fuel ratio control is not executed properly due to returned fuel contained in blow-by gas will be referred to as "over enrichment". Even if the actual value AFR of the air-fuel ratio does not enrich to such an extent that the air-fuel ratio control is not performed properly, a state may be regarded as "over enrichment" when the degree of enrichment of the actual value AFR in relation to the target value AFT exceeds a previously set allowable range.

In the blow-by gas returning apparatus 50 in the present embodiment, the possibility of occurrence of over enrichment of the air-fuel ratio depends mainly on the intake air amount GA and the degree of enrichment of the air-fuel ratio (the degree of deviation in relation to the rich side of the actual value AFR of the air-fuel ratio in relation to the target value AFT of the air-fuel ratio). Focusing on the dependency, the PCV opening degree TB is corrected based on the intake air amount GA and the degree of enrichment, whereby the occurrence of over enrichment of the air-fuel ratio is inhibited.

The air-fuel ratio correction factor kFA calculated as a value for reducing the injection amount QI by the air-fuel ratio control (hereinafter referred to as a reduction side correction factor kFL) reflects the degree of enrichment of the air-fuel ratio. Focusing on that, the PCV opening degree TB is corrected based on the intake air amount GA and the degree of enrichment, using the reduction side correction factor kFL as an index of the degree of enrichment of the air-fuel ratio.

The proportion of returned fuel to a air-fuel mixture increases as the intake air amount GA is reduced. Therefore, the influence of returned fuel on the actual value AFR of the air-fuel ratio, that is, the degree by which returned fuel makes the actual value AFR of the air-fuel ratio deviate to the rich side with respect to the target value AFT of the air-fuel ratio (hereinafter referred to as the promoted degree of enrichment) also increases in accordance with the increasing of the proportion of the returned fuel to the air-fuel mixture.

As shown in FIG. 6, the present inventor has confirmed that the tendency of change of the promoted degree of enrichment in relation to the intake air amount GA is different between a region where the intake air amount GA is less than a first reference amount GA1 and a region where the intake air amount GA is not less than the first reference amount GA1. That is, when the intake air amount GA is less than the first reference amount GA1, the promoted degree of enrichment caused by returned fuel is very large, and the change in the promoted degree of enrichment is very large, and the change in the promoted degree of enrichment in relation to the intake air amount GA becomes sufficiently small. Meanwhile, when the intake air amount GA is not less than the first reference amount GA1, the promoted degree of enrichment caused by returned fuel shows a tendency to become gradually smaller as the intake air amount GA increases. When the intake air amount GA is not less than a second reference amount GA2, which is greater than the first reference amount GA1, the promoted degree of enrichment caused by returned fuel is very small, and the change in the promoted degree of enrichment in relation to the intake air amount GA becomes sufficiently small. The first reference amount GA1 corresponds to the intake air amount GA when the engine load is in a low load region, and the second reference amount GA2 corresponds to the intake air amount GA when the engine load is in a high load region. These reference amounts are previously obtained through, for example, tests.

Meanwhile, when returned fuel is fed into the intake passage 49 while the actual value AFR of the air-fuel ratio deviates to the rich side relative to the target value AFT of the air-fuel ratio, the actual value AFR of the air-fuel ratio is further enriched. Therefore, the possibility that over enrichment of the air-fuel ratio occurs due to returned fuel (hereinafter referred to as likelihood of occurrence of over enrichment) increases in accordance with the degree of enrichment of the air-fuel ratio.

As shown in FIG. 7, the present inventor has confirmed that the tendency of change of the promoted degree of enrichment in relation to the reducing side correction factor kFL as the degree of enrichment is different between a region where the reducing side correction factor kFL is less than a reference correction factor kFL1, that is, a region where the degree of enrichment is smaller than a reference degree, and a region where the reducing side correction factor kFL is not less than the reference correction factor kFL1, that is, a region where the degree of enrichment is equivalent to or larger than the reference degree. That is, when the reducing side correction factor kFL is less than the reference correction factor kFL1, the likelihood of occurrence of over enrichment is very small, and the change in the likelihood of occurrence of over enrichment in relation to the reducing side correction factor kFL becomes sufficiently small. Meanwhile, when the reducing side correction factor kFL is not less than the reference correction factor kFL1, the likelihood of occurrence of over enrichment shows a tendency to become gradually greater as the reducing side correction factor kFL increases. The reference correction factor kFL1 is previously grasped through, for example, tests.

The correction of the PCV opening degree TB based on the intake air amount GA and the degree of enrichment, described above, is performed by virtue of the correction factor for the PCV opening degree TB calculated based on the tendency of the change in the promoted degree of enrichment in relation to the intake air amount GA, shown in FIG. 6, and the tendency of change in the promoted degree of enrichment in relation to the reducing side correction factor kFL, shown in FIG. 7.

A concrete example of control of the PCV valve 53 performed by the electronic control unit 60 will now be described with reference to FIGS. 8 to 12. A PCV opening degree changing process shown in FIGS. 8 and 9 shows a flow of a process executed as one of the ventilation control and is repeatedly executed by the electronic control unit 60 every predetermined control cycle.

Figure 8:
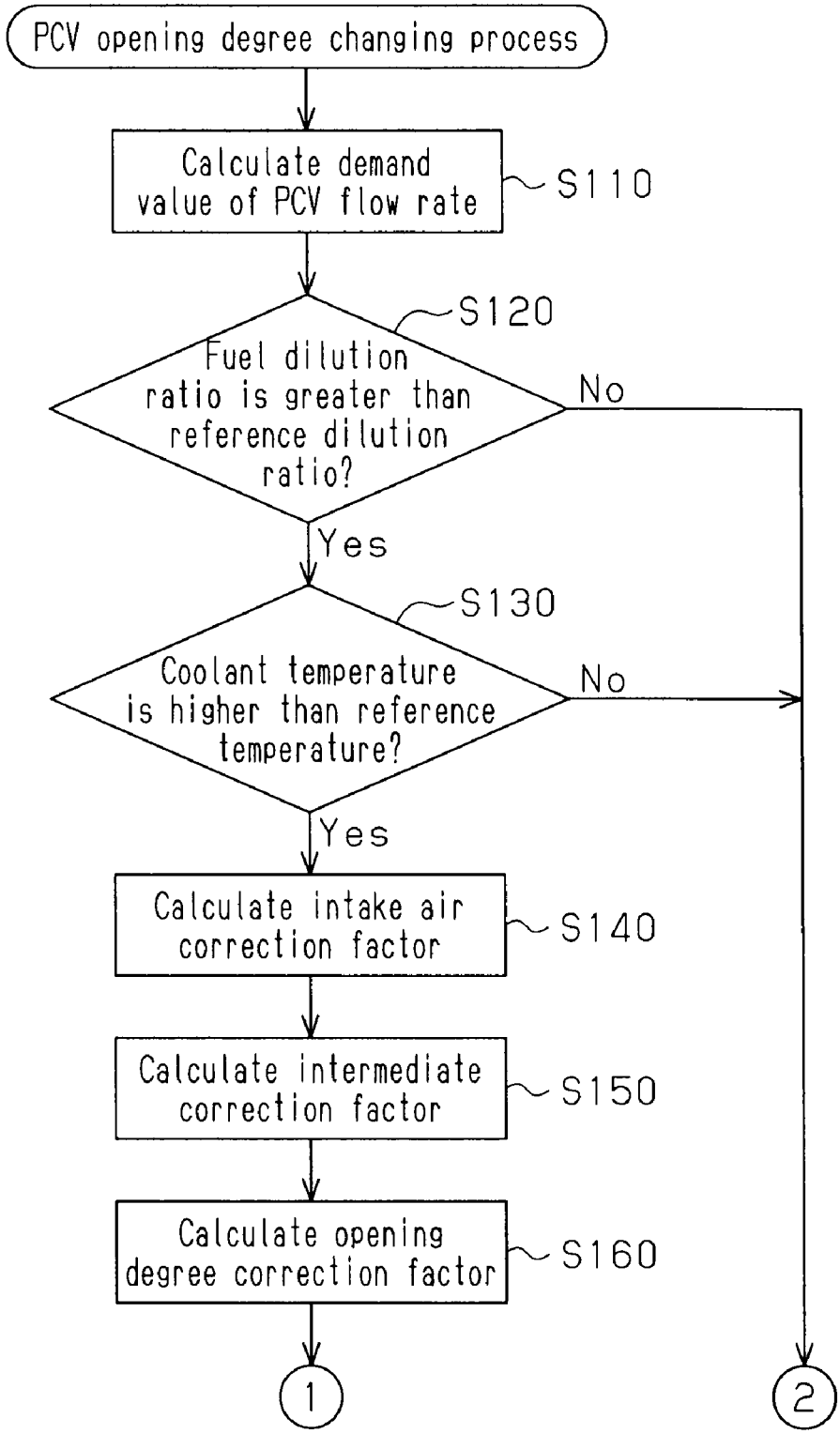
FIG. 8 is a flowchart showing the first half of a procedure of a PCV opening degree changing process performed by an electronic control unit of the in-cylinder injection internal combustion engine of FIG. 1.
Figure 9:
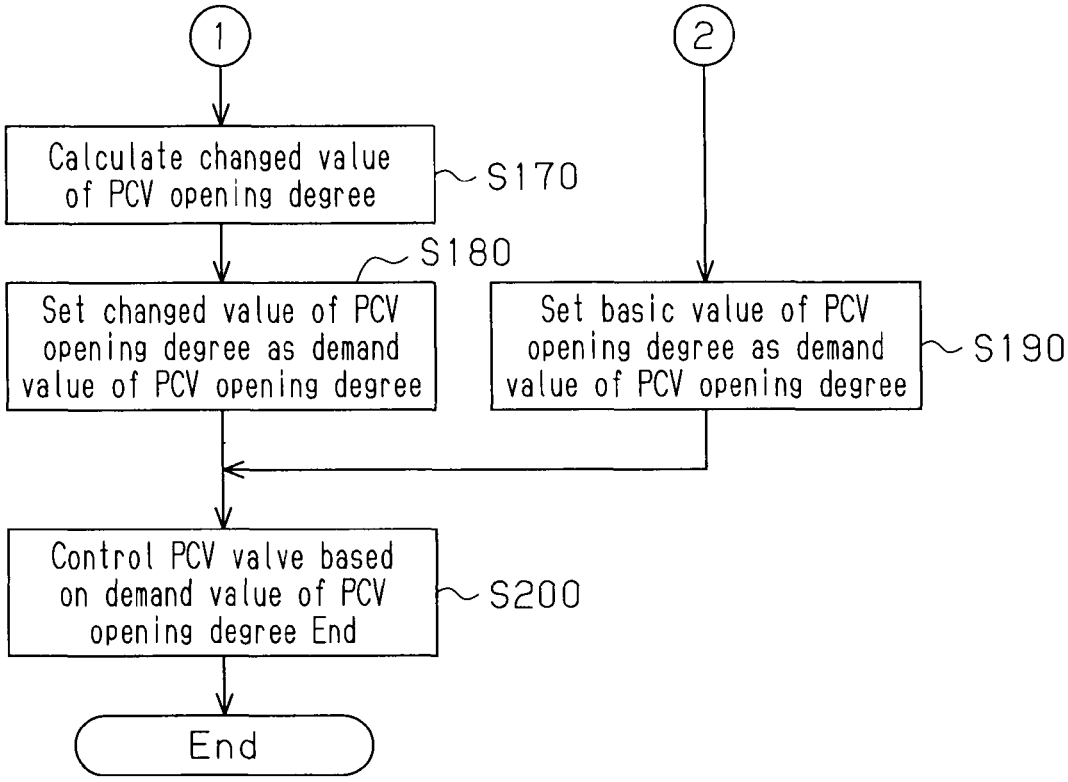
FIG. 9 is a flowchart showing the second half of the procedure of the PCV opening degree changing process performed by the electronic control unit of the in-cylinder injection internal combustion engine of FIG. 1.

As shown in FIG. 8, in the PCV opening degree changing process, a basic value of the PCV opening degree TB is first set based on the engine load and the engine rotational speed NE (step S110). Specifically, the engine load and the engine rotational speed NE are applied to a map which is previously stored in the electronic control unit 60 and is used for the calculation of the demand value GBT of the PCV flow rate, whereby the PCV flow rate GB in accordance with the engine operating state at that time (the demand value GBT of the PCV flow rate) is calculated. Then, based on the throttle opening degree TA and the engine rotational speed NE, that is, based on a parameter affecting the PCV flow rate GB, the PCV opening degree TB required for making the actual value GBR of the PCV flow rate be the same as the calculated demand value GBT is calculated, and the calculated PCV opening degree TB is set as a basic value of the PCV opening degree TB.

Figure 10:
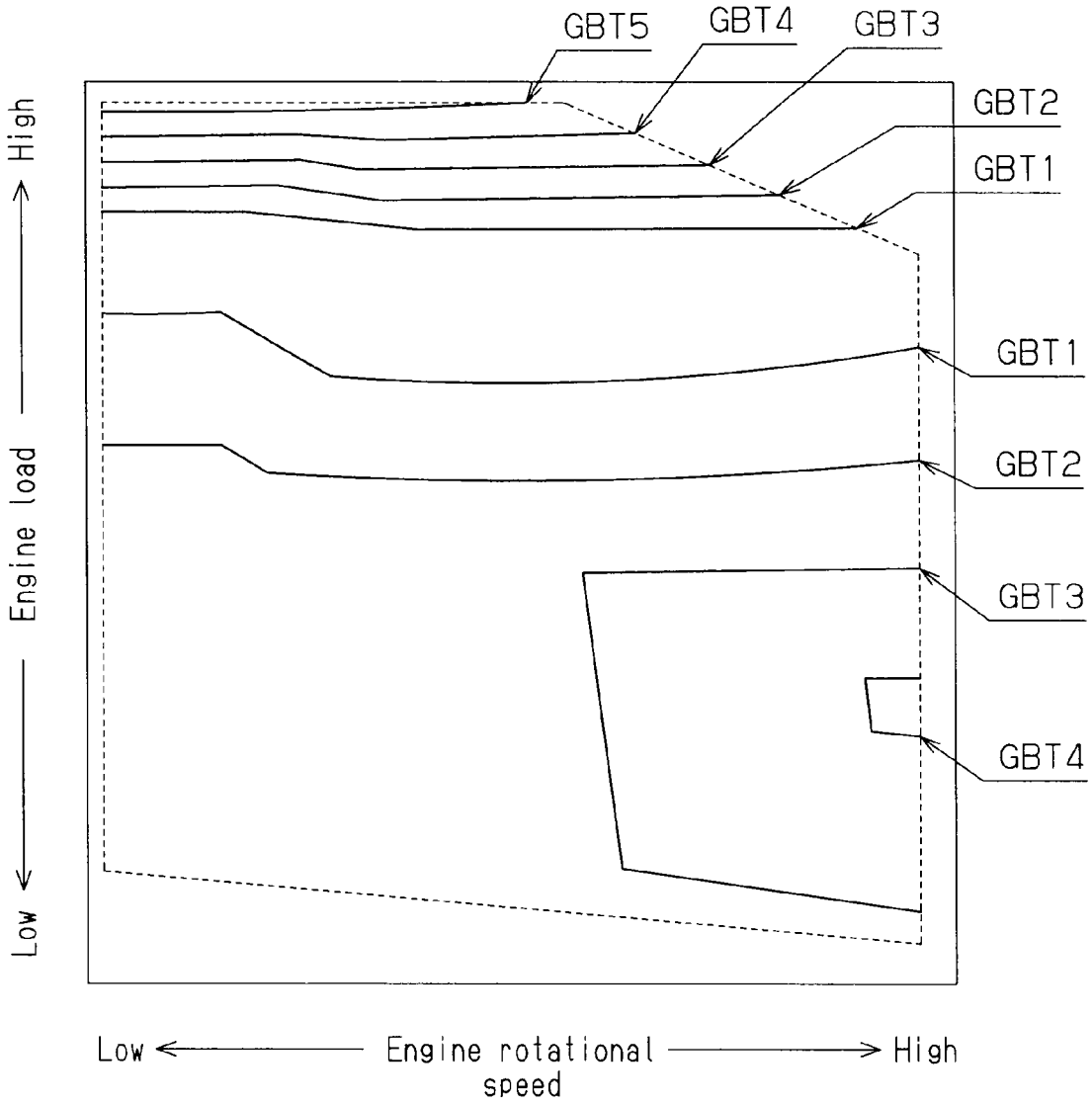
FIG. 10 is a calculation map of a PCV flow rate demand value used in the PCV opening degree changing process shown in FIGS. 8 and 9.

The above described map used for the calculation of the demand value GBT of the PCV flow rate is configured as shown in FIG. 10. On this map, one demand value GBT is set for one combination of the engine load and the engine rotational speed NE, and the demand value GBT corresponding to each combination of the engine load and the engine rotational speed NE is set in the entire operating region of the engine 10, that is, in the inside region surrounded by a dashed line in FIG. 10. Curves GBT1 to GBT5 respectively show that the demand value GBT of the PCV flow rate is the same, and the relationship of the magnitude of the demand value GBT among these curves is set as the following expression:

$$GBT1>GBT2>GBT3>GBT4>GBT5 \quad (1)$$

Further, the demand value GBT of the PCV flow rate is set between two adjacent curves with different demand values GBT of the PCV flow rate, for example, between the curve GBT1 and the curve GBT2 so as to be gradually reduced from the curve with a large demand value GBT (curve GBT1) to the curve with a small demand value GBT (curve GBT2). Instead of this setting, for example, between two adjacent curves with different demand values GBT of the PCV flow rate, the demand value GBT of the PCV flow rate may be a value on one of these two adjacent curves.

Further, on the map shown in FIG. 10, the relationship of the engine load and the engine rotational speed NE with the demand value GBT of the PCV flow rate is set as follows. That is, the demand value GBT is set to maximum when the engine load is within a middle load region, the demand value GBT is gradually reduced as the engine load is transferred from the middle load region to a high load region. The demand value GBT is set to minimum in the highest load region. Further, the demand value GBT is gradually reduced as the engine load transferred from the middle load region to a high load region In a high rotation low load region of the low load region, the demand value GBT is set to be smaller than other low load regions.

As shown in FIG. 8, the demand value GBT of the PCV flow rate is calculated from the map (step S110), and thereafter, whether the fuel dilution ratio of engine oil is higher than a reference dilution ratio is determined (step S120). When the fuel dilution ratio is low, the returned fuel amount QR of returned fuel fed into the combustion chamber 31 together with blow-by gas is reduced. Under such conditions, it is predicted that over enrichment of the actual value AFR of the air-fuel ratio due to the feed of blow-by gas into the intake passage 49 will not occur. That is, it is predicted that there is no particular problem in the subsequent process even if the correction for reducing the PCV opening degree TB is not executed. Thus, in the determination process in step S120, in order to avoid the unnecessary correction of the PCV opening degree TB, the necessity of the correction of the PCV opening degree TB is determined based on the fuel dilution ratio. That is, the reference dilution ratio is previously set as a value for determining whether the fuel dilution ratio increases to such an extent that the returned fuel amount QR exceeds the allowable range.

In the determination process in step S120, when the fuel dilution ratio is determined to be higher than the reference dilution ratio, whether the coolant temperature THW from the coolant temperature sensor 65 is higher than a reference temperature is determined (step S130). When the coolant temperature THW is lower than the reference temperature, the diluted fuel does not evaporate from the engine oil. Under the conditions, it is predicted that over enrichment of the actual value AFR of the air-fuel ratio due to the feed of blow-by gas into the intake passage 49 will not occur. That is, it is predicted that there is no particular problem in the subsequent process even if the correction for reducing the PCV opening degree TB is not performed. Thus, in the determination process in step S130, in order to avoid the unnecessary correction of the PCV opening degree TB, the necessity of the correction of the PCV opening degree TB is determined based on the coolant temperature THW. That is, the reference temperature is previously set as a value for determining whether the diluted fuel evaporates.

When each of conditions in the determination process in steps S120 and S130 is established, the correction factor for the basic value of the PCV opening degree TB (hereinafter referred to as an opening degree correction factor kTB) is calculated through process in steps S140 to S180, and a value calculated based on the opening degree correction factor kTB and the basic value of the PCV opening degree TB (hereinafter referred to as a changed value of the PCV opening degree TB) is set as the demand value TBT of the PCV opening degree. Meanwhile, when it is determined that either of the conditions in the determination process in steps S120 or S130 is not established, the basic value of the PCV opening degree is set as the demand value TBT of the PCV opening degree, through the process in step S190.

After the process in step S180 or S190, control is executed on the PCV valve 53 such that the actual value TBR of the PCV opening degree is maintained at the demand value set in step S180 or step S190 (step S200).

Hereinafter, the process from steps S140 to S180 is described in detail.

First, an intake air correction factor kGA as the correction factor for the PCV opening degree TB is calculated based on the intake air amount GA obtained based on a value detected by the air flow meter 63 (step S140). Specifically, the intake air amount GA is applied to a map which is previously stored in the electronic control unit 60 and is used for calculation of the intake air correction factor kGA, and the intake air correction factor kGA is calculated based on this map.

Figure 11:
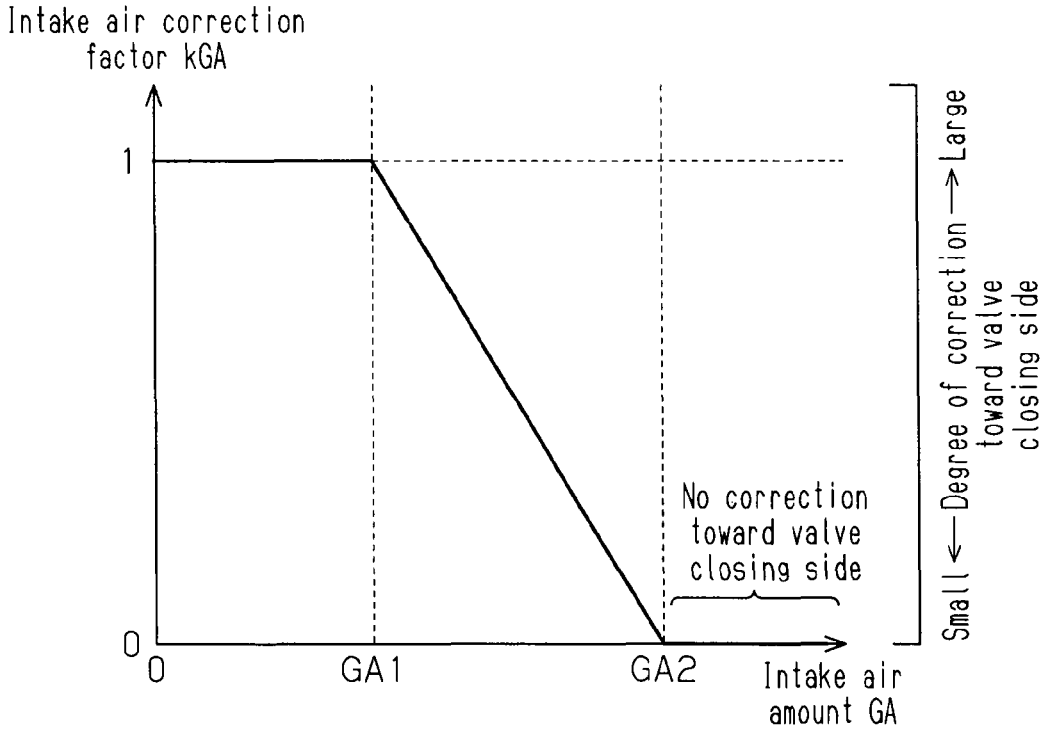
FIG. 11 is a calculation map of an intake air correction factor used in the PCV opening degree changing process shown in FIGS. 8 and 9.

The above described map for the calculation of the intake air correction factor kGA may be configured, for example, as shown in FIG. 11. The relationship between the intake air amount GA and the intake air correction factor kGA on this map is, as shown in FIG. 6, constituted as follows based on the tendency of change in the promoted degree of enrichment in relation to the intake air amount GA, described above.

In the region where the intake air amount GA is less than the first reference amount GA1, the promoted degree of enrichment degree caused by returned fuel is very large. In the region where the intake air amount GA is less than the first reference amount GA1, regarding a requirement for reducing the possibility of occurrence of over enrichment of the air-fuel ratio and a requirement for promoting ventilation of the inside of the crank chamber 32, it is considered that the former requirement is required to be prioritized. Therefore, it can be said that the degree of correction toward the valve closing side of the PCV opening degree TB based on the intake air amount GA is preferably rendered sufficiently large. Thus, the intake air correction factor kGA corresponding to the region where the intake air amount GA is less than the first reference amount GA1 is greater than the intake air correction factor kGA corresponding to a region where the intake air amount GA is not less than the first reference amount GA1 and less than the second reference amount GA2 and a region where the intake air amount GA is not less than the second reference amount GA2, such that the degree of correction toward the valve closing side of the PCV opening degree TB becomes large. That is, when the intake air correction factor kGA is set within a range between "0" and "1", in the region where the intake air amount GA is less than the first reference amount GA1, the intake air correction factor kGA is set to "1", which is the maximum value, such that the degree of correction in relation to the valve closing side of the PCV opening degree TB becomes large. The upper limit of the intake air correction factor kGA can be set to a value greater than "1". In this case, in the region where the intake air amount GA is less than the first reference amount GA1, the intake air correction factor kGA is set to be a value greater than "1".

In the region where the intake air amount GA is not less than the first reference amount GA1 and less than the second reference amount GA2, the promoted degree of enrichment caused by returned fuel shows a tendency to become gradually smaller as the intake air amount GA increases. In the region where the intake air amount GA is not less than the first reference amount GA1 and less than the second reference amount GA2, it is considered that the requirement for reducing the possibility of occurrence of over enrichment of the air-fuel ratio and the requirement for promoting ventilation of the inside of the crank chamber 32 can both be satisfied. Therefore, it can be said that the degree of correction toward the valve closing side of the PCV opening degree TB based on the intake air amount GA is preferably decreased as the increase of the intake air amount GA increases. Thus, the intake air correction factor kGA corresponding to the region where the intake air amount GA is not less than the first reference amount GA1 and less than the second reference amount GA2 is set so as to become gradually smaller as the intake air amount GA increases. That is, when the intake air correction factor kGA is set within the range between "0" and "1", the intake air correction factor kGA is set so as to become gradually smaller from "1" to "0", such that the degree of correction toward the valve closing side of the PCV opening degree TB becomes gradually small.

In the region where the intake air amount GA is not less than the second reference mount GA2, the promoted degree of enrichment caused by returned fuel is very small. That is, in the region where the intake air amount GA is not less than the second reference mount GA2, regarding the requirement for reducing the possibility of occurrence of over enrichment of the air-fuel ratio and the requirement for promoting ventilation of the inside of the crank chamber 32, it is considered that the latter requirement is required to be prioritized (because it is considered that it is unnecessary to satisfy the former requirement). Therefore, it can be said that the degree of correction toward the valve closing side of the PCV opening degree TB based on the intake air amount GA is preferably rendered sufficiently small. Thus, the intake air correction factor kGA corresponding to the region where the intake air amount GA is not less than the second reference amount GA2 is smaller than the intake air correction factor kGA corresponding to the region where the intake air amount GA is less than the first reference amount GA1 and the region where the intake air amount GA is not less than the first reference amount GA1 and less than the second reference amount GA2, such that the degree of correction toward the valve closing side of the PCV opening degree TB becomes small. That is, when the intake air correction factor kGA is set within a range between "0" and "1", the intake air correction factor kGA is set to "0" in the region where the intake air amount GA is not less than the second reference amount GA2, such that the degree of correction toward the valve closing side of the PCV opening degree TB becomes minimum. The lower limit of the intake air correction factor kGA can be set to a value greater than "0", and in this case, the intake air correction factor kGA is set to the value greater than "0" in the region where the intake air amount GA is not less than the second reference amount GA2, such that the degree of correction toward the valve closing side of the PCV opening degree TB becomes minimum.

In step S150, the reducing side correction factor kFL is multiplied by the intake air correction factor kGA, and the value obtained as the calculation result is set as an intermediate correction factor kTL. That is, the reducing side correction factor kFL reflecting the tendency of change of the promoted degree of enrichment in relation to the intake air amount GA (degree of enrichment) is set as the intermediate correction factor kTL. The smoothed reducing side correction factor kFL calculated by the air-fuel ratio control is used as the reducing side correction factor kFL on which the intake air correction factor kGA will be reflected. The smoothing of the reducing side correction factor kFL may be performed using, for example, the reducing side correction factor kFL in a previous calculation period and the reducing side correction factor kFL in a present calculation period, calculated in the air-fuel ratio control. Alternatively, the air-fuel ratio correction value FAF and the air-fuel ratio learning value FAG in a previous calculation period and these values in a present calculation period, calculated in the air-fuel ratio control, may be respectively smoothed to calculate the reducing side correction factor kFL on the basis thereof.

In step S160, the opening degree correction factor kTB which is the correction factor for the PCV opening degree TB is calculated based on the intermediate correction factor kTL calculated in step S150. Specifically, the intermediate correction factor kTL is applied to a map which is previously stored in the electronic control unit 60 and is used for calculation of the opening degree correction factor kTB, and the opening degree correction factor kTB is calculated based on this map.

Figure 12:
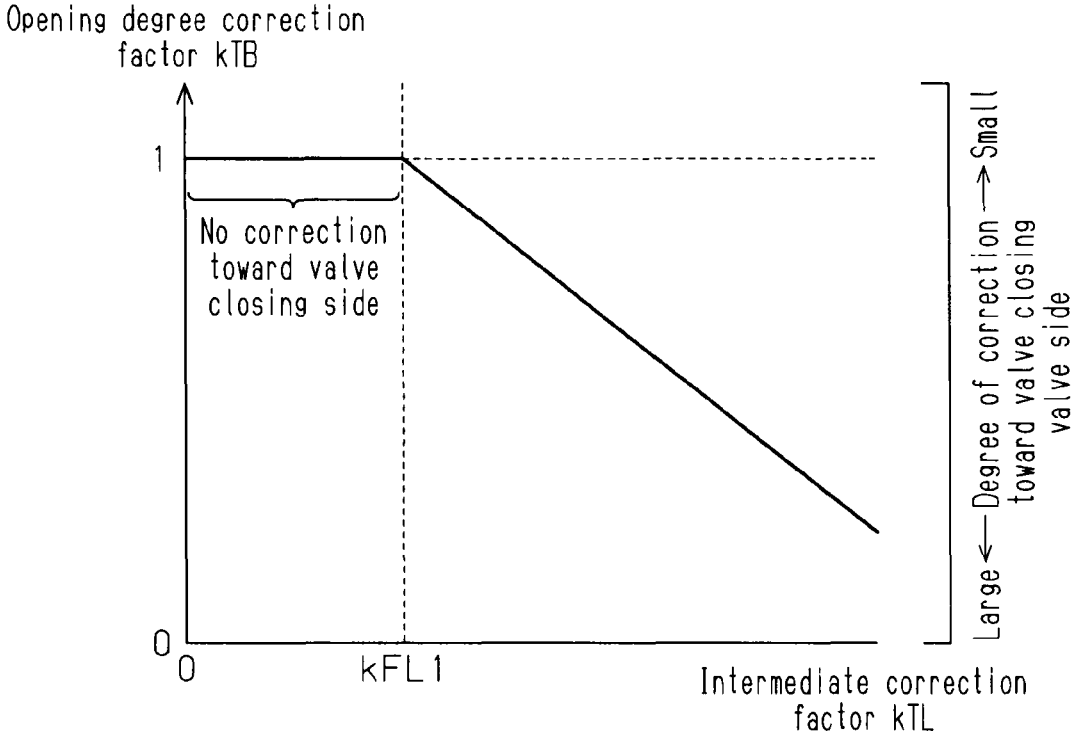
FIG. 12 is a calculation map of an opening degree correction factor used in the PCV opening degree changing process shown in FIGS. 8 and 9.

The map for the calculation of the opening degree correction factor kTB may be configured, for example, as shown in FIG. 12. On this map, the relationship between the intermediate correction factor kTL and the opening degree correction factor kTB is, as shown in FIG. 7, constituted as follows based on the tendency of change in the likelihood of occurrence of over enrichment in relation to the reducing side correction factor kFL, described above.

In a region where the intermediate correction factor kTL is less than the reference correction factor kFL1, the likelihood of occurrence of over enrichment caused by returned fuel is very small. That is, in the region where the intermediate correction factor kTL is less than the reference correction factor kFL1, regarding the requirement for reducing the possibility of occurrence of over enrichment of the air-fuel ratio and the requirement for promoting ventilation of the inside of the crank chamber 32, it is considered that the latter requirement is required to be prioritized. Therefore, it can be said that the degree of correction toward the valve closing side of the PCV opening degree TB based on the intermediate correction factor kTL is preferably rendered sufficiently small. Thus, the opening degree correction factor kTB corresponding to the region where the intermediate correction factor kTL is less than the reference correction factor kFL1 is larger than the opening degree correction factor kTB corresponding to the region where the intermediate correction factor kTL is not less than the reference correction factor kFL1. That is, when the opening degree correction factor kTB is set within a range between "0" and "1", the degree of correction toward the valve closing side of the PCV opening degree TB is minimum, and the opening degree correction factor kTB is set to "1" in order to prevent the PCV opening degree TB from being corrected so as to approach the valve closing side. The upper limit of the opening degree correction factor kTB can be set to be greater than "1". In this case, the opening degree correction factor kTB is set to a value larger than "1" such that the degree of correction toward the valve closing side of the PCV opening degree TB is minimum.

Next, in the region where the intermediate correction factor kTL is not less than the reference correction factor kFL1, the likelihood of occurrence of over enrichment caused by returned fuel shows a tendency to become gradually larger as the intermediate correction factor kTL increases. That is, in the region where the intermediate correction factor kTL is not less than the reference correction factor kFL1, it is considered that both of the requirement for reducing the possibility of occurrence of over enrichment of the air-fuel ratio and the requirement for promoting ventilation of the inside of the crank chamber 32 can be satisfied. Therefore, it can be said that the degree of correction toward the valve closing side of the PCV opening degree TB based on the intermediate correction factor kTL is preferably rendered gradually larger as the intermediate correction factor kTL increases. Thus, the opening degree correction factor kTB corresponding to the region where the intermediate correction factor kTL is not less than the reference correction factor kFL1 is set so as to become gradually smaller as the intermediate correction factor kTL increases. That is, when the opening degree correction factor kTB is set within the range between "0" and "1", the opening degree correction factor kTB is set so as to become gradually smaller from "1" to "0", such that the degree of correction toward the valve closing side of the PCV opening degree TB becomes gradually large.

As described above, the opening degree correction factor kTB is set as a value for reducing the possibility of occurrence of over enrichment of the air-fuel ratio caused by returned fuel, and, at the same time, is set as a value causing no excessive correction toward the valve closing side of the PCV opening degree TB based on the engine operating state, that is, the basic value of the PCV opening degree TB. That is, while the occurrence of over enrichment of the air-fuel ratio is reliably inhibited through the correction toward the valve closing side of the PCV opening degree TB, the opening degree correction factor kTB is set such that the requirement for ventilation of the inside of the crank chamber 32 can be satisfied as much as possible. In other words, the opening degree correction factor kTB is set such that any of the minimum and the adjacent degrees allowing the reliable inhibition of the occurrence of over enrichment of the air-fuel ratio is ensured as the degree of correction toward the valve closing side of the PCV opening degree TB, whereby it is possible to inhibit as much as possible the degree of ventilation in the crank chamber 32 from decreasing due to the correction of the PCV opening degree TB.

The basic value of the PCV opening degree TB is multiplied by the opening degree correction factor kTB (step S170), and the value obtained as the calculation result is set as a changed value of the PCV opening degree TB. The changed value of the PCV opening degree TB is set as the demand value TBT of the PCV opening degree (step S180).

As described above, in the PCV opening degree changing process in the present embodiment, the opening correction factor kTB is calculated in the following manner. That is, the intake air correction factor kGA is calculated based on the intake air amount GA. The calculated intake air correction factor kGA is reflected in the reducing side correction factor kFL to calculate correction factor kTL. The opening degree correction factor kTB is calculated based on the calculated correction factor kTL.

The present embodiment has the following advantages.

(1) In the present embodiment, the basic value of the PCV opening degree TB is corrected based on the intake air amount GA and the reducing side correction factor kF (the degree of enrichment) such that the PCV opening degree TB decreases. Therefore, the occurrence of over enrichment of the air-fuel ratio is reliably inhibited. Further, the demand value of the PCV opening degree TB set based on the engine operating state, that is, the basic value of the PCV opening degree TB is corrected, whereby the inhibition of over enrichment is achieved. As a result, unlike the case where the PCV valve 53 is completely closed when the fuel dilution ratio of the engine oil is high, the occurrence of over enrichment of the air-fuel ratio is reliably inhibited while ventilating the inside of the crank chamber 32.

(2) In the present embodiment, the basic value of the PCV opening degree TB is corrected so as to further approach a value on the valve closing side as the intake air amount GA is reduced. That is, the returned fuel amount QR is reduced through the control of the PCV valve 53 as the promoted degree of enrichment of the air-fuel ratio caused by returned fuel becomes large. Thus, the occurrence of over enrichment of the actual value AFR of the air-fuel ratio is reliably inhibited.

(3) In the present embodiment, the tendency of change of the intake air correction factor kGA in relation to the intake air amount GA (the degree of correction toward the valve closing side of the PCV opening degree TB) is different between the region where the intake air amount GA is less than the first reference amount GA1 and the region where the intake air amount GA is not less than the first reference amount GA1. Thus, the PCV opening degree TB is corrected so as to be maintained at a level corresponding to the influence of returned fuel on the actual value AFR of the air-fuel ratio. Furthermore, it is possible to reliably inhibit the degree of ventilation of the inside of the crank chamber 32 from being unnecessarily reduced due to the excessive correction toward the valve closing side of the PCV opening degree TB.

(4) In the present embodiment, in the region where the intake air amount GA is less than the first reference amount GA1, the intake air correction factor kGA is set such that the degree of correction toward the valve closing side of the PCV opening degree TB is maximum. That is, the degree of correction toward the valve closing side of the PCV opening degree TB corresponding to the region where the intake air amount GA is less than the first reference amount GA1 is set to be greater than the degree of correction toward the valve closing side of the PCV opening degree TB corresponding to the region where the intake air amount GA is not less than the first reference amount GA1 and less than the second reference amount GA2, and the degree of correction toward the valve closing side of the PCV opening degree TB corresponding to the region where the intake air amount GA is not less than the second reference amount GA2. Thus, the occurrence of over enrichment of the actual value AFR of the air-fuel ratio is reliably inhibited.

(5) In the present embodiment, in the region where the intake air amount GA is not less than the first reference amount GA1, the degree of correction toward the valve closing side of the PCV opening degree TB based on the intake air correction factor kGA is decreased as the intake air amount GA increases. Thus, an unnecessary reduction in the amount of blow-by gas fed into the intake passage 49, that is, an unnecessary reduction in the degree of ventilation of the inside of the crank chamber 32 is reliably inhibited.

(6) In the present embodiment, in the region where the intake air amount GA is not less than the second reference amount GA2, the intake air correction factor kGA is set such that the degree of correction toward the valve closing side of the PCV opening degree TB is minimum. That is, the intake air correction factor kGA is set in order to prevent the basic value of the PCV opening degree TB from being corrected so as to approach the valve closing side. Thus, an unnecessary reduction in the amount of blow-by gas fed into the intake passage 49, that is, the unnecessary reduction in the degree of ventilation of the inside of the crank chamber 32 is reliably inhibited.

(7) In the present embodiment, the basic value of the PCV opening degree TB is corrected so as to further approach a value on the valve closing side as the intermediate correction factor kTL as the reducing side correction factor kFL (the degree of enrichment of the air-fuel ratio) increases. That is, the returned fuel amount QR is reduced through the control of the PCV valve 53 as the likelihood of occurrence of over enrichment of the air-fuel ratio caused by returned fuel becomes large. Thus, the occurrence of over enrichment of the actual value AFR of the air-fuel ratio is reliably inhibited.

(8) In the present embodiment, the tendency of change of the opening degree correction factor kTB (the degree of correction toward the valve closing side of the PCV opening degree TB) to the intermediate correction factor kTL as the reducing side correction factor kFL is different between the region where the intermediate correction factor kTL is less than the reference correction factor kFL1 and the region where the intermediate correction factor kTL is not less than the reference correction factor kFL1. Thus, the PCV opening degree TB is corrected so as to be maintained at a level corresponding to the influence of returned fuel on the actual value AFR of the air-fuel ratio. Furthermore, it is possible to reliably inhibit the degree of ventilation of the inside of the crank chamber 32 from being unnecessarily reduced due to the excessive correction toward the valve closing side of the PCV opening degree TB.

(9) In the present embodiment, in the region where the intermediate correction factor kTL as the reducing side correction factor kFL is less than the reference correction factor kFL1, the opening degree correction factor kTB is set such that the degree of correction toward the valve closing side of the PCV opening degree TB is minimum. That is, the opening degree correction factor kTB is set in order to prevent the basic value of the PCV opening degree TB from being corrected so as to approach the valve closing side. Thus, the unnecessary reduction in the amount of blow-by gas fed into the intake passage 49, that is, the unnecessary reduction in the degree of ventilation of the inside of the crank chamber 32 is reliably inhibited.

(10) In the present embodiment, in the region where the intermediate correction factor kTL as the reducing side correction factor kFL is not less than the reference correction factor kFL1, the degree of correction toward the valve closing side of the PCV opening degree TB based on the opening degree correction factor kTB is increased as the intermediate correction factor kTL increases. Thus, the occurrence of over enrichment of the actual value AFR of the air-fuel ratio is reliably inhibited.

(11) Under the conditions where the intake air amount GA is sufficiently small and the reducing side correction factor kFL is sufficiently large, the possibility of occurrence of over enrichment of the air-fuel ratio is very large. However, in the present embodiment, when the intake air amount GA is sufficiently small, that is, when the intake air amount GA is less than the first reference amount GA1, the degree of correction toward the valve closing side of the PCV opening degree TB based on the intake air amount GA is set to maximum. Further, when the intermediate correction factor kTL is sufficiently large, that is, when the intermediate correction factor kTL deviates from the reference correction factor kFL1 so as to be sufficiently large, the opening degree correction factor kTB is set such that the degree of correction toward the valve closing side of the PCV opening degree TB based on the intermediate correction factor kTL is large. Thus, even under the above conditions, the occurrence of over enrichment of the actual value AFR of the air-fuel ratio is reliably inhibited.

The above embodiment may be modified as follows.

In the above embodiment, the procedure for calculating the opening degree correction factor kTB may be modified as follows. That is, for example, a calculation map in which the relationship between the intake air amount GA and the reducing side correction factor kFL (the degree of enrichment), and the opening degree correction factor kTB is previously specified may be provided, and the opening degree correction factor kTB corresponding to the intake air amount GA and the reducing side correction factor kFL at any given time may be calculated based on the calculation map.

In the above embodiment, the reducing side correction factor kFL is regarded as the degree of enrichment of the actual value AFR of the air-fuel ratio, and the PCV opening degree TB is corrected based on the degree of enrichment. However, instead of this, the PCV opening degree TB may be corrected based on a deviation amount between the actual value AFR of the air-fuel ratio detected by the air-fuel ratio sensor 66 and the target value AFT of the air-fuel ratio. In short, the degree of enrichment of the actual value AFR of the air-fuel ratio may be acquired not only in the manner described in the above embodiment, but also in any other suitable manner.

Although the in-cylinder injection engine is used in the above embodiment, the present invention may be applied to any type of engine as long as it performs air-fuel ratio control in which the air-fuel ratio correction factor is updated such that the fuel injection amount is reduced based on the deviation of the actual air-fuel ratio to the rich side with respect to the target air-fuel ratio. Moreover, the blow-by gas returning apparatus may have configurations other than the configuration shown in the above embodiment as long as it has an electronically controlled PCV valve.

What is claimed is:

1. An electronically controlled blow-by gas returning apparatus for an internal combustion engine, wherein the engine corrects a fuel injection amount such that the fuel injection amount is reduced in accordance with a degree of enrichment of an actual air-fuel ratio in relation to a target air-fuel ratio, the blow-by gas returning apparatus comprising:

an electronically controlled ventilation valve which regulates a flow rate of blow-by gas in a crank chamber of the engine fed into an intake passage; and a control unit for controlling the ventilation valve, wherein the control unit sets a demand value of an opening degree of the ventilation valve based on an engine operating state, and controls the opening degree of the ventilation valve such that the actual value of the opening degree of the ventilation valve is maintained at the demand value, and wherein the control unit corrects the demand value based on a relation between the degree of enrichment and an intake air amount, which is the amount of air fed into a combustion chamber of the internal combustion engine, such that the degree of enrichment of the actual air-fuel ratio (AFR) in relation to the target air-fuel ratio (AFT) does not exceed a previously set allowable range.

2. The blow-by gas returning apparatus according to claim 1, wherein the control unit corrects the demand value based on the intake air amount so as to inhibit the degree by which fuel contained in the blow-by gas causes the actual air-fuel ratio to deviate to a rich side with respect to the target air-fuel ratio from increasing as the intake air amount is reduced.

3. The blow-by gas returning apparatus according to claim 1, wherein the control unit corrects the demand value such that the demand value further approaches a value for further closing of the valve as the intake air amount is reduced.

4. The blow-by gas returning apparatus according to claim 3, wherein the control unit makes tendency of change of the degree of intake air correction in relation to the intake air amount different between a region where the intake air amount is smaller than a first reference amount and a region where the intake air amount is greater than the first reference amount, and wherein the degree of intake air correction is a degree by which the demand value is caused to approach a value for further closing of the valve based on the intake air amount.

5. The blow-by gas returning apparatus according to claim 4, wherein, in the region where the intake air amount is smaller than the first reference amount, the control unit maintains the degree of intake air correction at maximum regardless of change in the intake air amount.

6. The blow-by gas returning apparatus according to claim 4, wherein, in the region where the intake air amount is greater than the first reference amount, the control unit decreases the degree of intake air correction as the intake air amount increases.

7. The blow-by gas returning apparatus according to claim 6, wherein, in a region where the intake air amount is greater than a second reference amount, the control unit sets the degree of intake air correction so as to prevent the demand value from being corrected to approach a value for further closing of the valve, the second reference amount being greater than the first reference amount.

8. The blow-by gas returning apparatus according to claim 1, wherein, as the degree of enrichment becomes large, the control unit corrects the demand value such that the demand value further approaches a value for further closing of the valve.

9. The blow-by gas returning apparatus according to claim 1, wherein the control unit makes tendency of change of the degree of deviation correction in relation to the degree of enrichment different between a region where the degree of enrichment is smaller than a reference degree and a region where the degree of enrichment is greater than the reference degree, and wherein the degree of deviation correction is a degree by which the demand value is caused to approach a value for further closing of the valve based on the degree of enrichment.

10. The blow-by gas returning apparatus according to claim 9, wherein, in the region where the degree of enrichment is smaller than the reference degree, the control unit maintains the degree of deviation correction at a minimum value regardless of change in the degree of enrichment.

11. The blow-by gas returning apparatus according to claim 9, wherein, in the region where the degree of enrichment is greater than the reference degree, the control unit increases the degree of deviation correction as the degree of enrichment increases.

12. The blow-by gas returning apparatus according to claim 1, wherein, the control unit corrects the demand value based on a decrease correction value and an intake air amount only when the fuel dilution ratio of engine lubricant oil is higher than a reference dilution ratio.

13. The blow-by gas returning apparatus according to claim 1, wherein the control unit sets the demand value based on at least one of an engine load and an engine rotational speed, which indicate the engine operating state, and controls the ventilation valve such that the actual value of the opening degree of the ventilation valve approaches the demand value, and wherein, when the control unit has corrected the demand value based on the degree of enrichment and the intake air amount such that the demand value approaches the valve closing side, the control unit sets the corrected demand value as a new demand value and controls the ventilation valve such that the actual value of the opening degree of the ventilation valve approaches the new demand value.

* * * * *